US007529506B2

(12) United States Patent
Ogawa

(10) Patent No.: US 7,529,506 B2
(45) Date of Patent: May 5, 2009

(54) IMAGE FORMING APPARATUS

(75) Inventor: Daisuke Ogawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 345 days.

(21) Appl. No.: 11/340,748

(22) Filed: Jan. 27, 2006

(65) Prior Publication Data

US 2006/0171740 A1 Aug. 3, 2006

(30) Foreign Application Priority Data

Jan. 31, 2005 (JP) ..... 2005-024255

(51) Int. Cl.
*G03G 21/00* (2006.01)
*G03G 15/00* (2006.01)

(52) U.S. Cl. ..... 399/124; 399/364

(58) Field of Classification Search ..... 399/124, 399/364, 401
See application file for complete search history.

(56) References Cited

U.S. PATENT DOCUMENTS 6,980,766 B2 12/2005 Ito
7,029,006 B2 * 4/2006 Izumi et al. ..... 399/124 X
2004/0041333 A1 3/2004 Izumi et al.
2004/0190963 A1 9/2004 Ito

FOREIGN PATENT DOCUMENTS

| | | |
|---|---|---|
| JP | A-7-314856 | 12/1995 |
| JP | A 8-188344 | 7/1996 |
| JP | A 11-194563 | 7/1999 |
| JP | A 2000-141778 | 5/2000 |
| JP | A 2003-200634 | 7/2003 |
| JP | A-2004-294988 | 10/2004 |
| JP | A 2004-294988 | 10/2004 |
| JP | 2005289523 A * | 10/2005 |

* cited by examiner

*Primary Examiner*—David M Gray
*Assistant Examiner*—Erika Villaluna
(74) *Attorney, Agent, or Firm*—Oliff & Berridge, PLC

(57) ABSTRACT

An image forming apparatus includes: an apparatus main body that is provided with an image forming section that forms image on a sheet; a first guide member that guides the sheet along a sheet conveying path and is configured to be displaceable relative to the apparatus main body; a second guide member that guides the sheet along the sheet conveying path and is configured to be displaceable relative to the apparatus main body; and a single detecting unit that detects that both of the first guide member and the second guide member are respectively disposed at normal guide positions for guiding the sheet.

17 Claims, 13 Drawing Sheets

IMAGE FORMING APPARATUS

CROSS REFERENCE TO RELATED APPLICATION

This application claims priority from Japanese Patent Application No. 2005-024255 filed on Jan. 31, 2005, the entire subject matter of which is incorporated herein by reference.

TECHNICAL FIELD

The present invention may relate to an image forming apparatus.

BACKGROUND

In a background art, there is widely provided an image forming apparatus of a laser printer or the like having a configuration including an image forming section and a sheet conveying path for conveying a sheet as a recorded medium to the image forming section. The sheet conveying path is generally constituted by a plurality of guide members and various processings are carried out at inside of the image forming apparatus while guiding the recorded medium by the guide members. There is an example of such an image forming apparatus shown in, for example, JP-A-2004-294988.

Meanwhile, according to the configuration disclosed in JP-A-2004-294988, portions of the guide members constituting the conveying path are made to be displaceable to facilitate maintenance when a clogging occurs in the conveying path. Specifically, the image forming apparatus disclosed in JP-A-2004-294988 has a configuration capable of forming images on both faces of the recorded medium and a rear cover member constituting an inverting path and a reconveying tray constituting a reconveying path are constituted as portions of the guide members for guiding the recorded medium. According to the apparatus, when the sheet is clogged at vicinities of the members, maintenance is facilitated by operating to open or close or operating to attach and detach the members.

On the other hand, according to the image forming apparatus in which portions of the guide members are displaceably configured in this way, in order to avoid the recorded medium from being carried when the guide members are not disposed at normal guide positions, it is necessary to provide a configuration of detecting whether the guide members are disposed at the normal guide positions. However, according to the configuration of the background art, detecting units are provided to respectives of the plurality of guide members and detection is carried out for the respective guide members and therefore, a number of parts is increased and the apparatus tends to be large-sized.

SUMMARY

One aspect of the present invention may provide a configuration promoting a maintenance facilitating performance of an apparatus by configuring a plurality of guide members constituting a conveying path of a recorded medium displaceable and capable of simply detecting whether the plurality of guide members are disposed at normal positions without being large-sized.

An image forming apparatus includes: an apparatus main body that is provided with an image forming section that forms image on a sheet; a first guide member that guides the sheet along a sheet conveying path and is configured to be displaceable relative to the apparatus main body; a second guide member that guides the sheet along the sheet conveying path and is configured to be displaceable relative to the apparatus main body; and a single detecting unit that detects that both of the first guide member and the second guide member are respectively disposed at normal guide positions for guiding the sheet.

DETAILED DESCRIPTION

Illustrative aspects of the present invention will be described hereinbelow by reference to the drawings.

First Illustrative Aspect

A first illustrative aspect will be explained in reference to FIG. 1 through FIG. 9.

1. Total Configuration of the Illustrative Aspect

Figure 1:
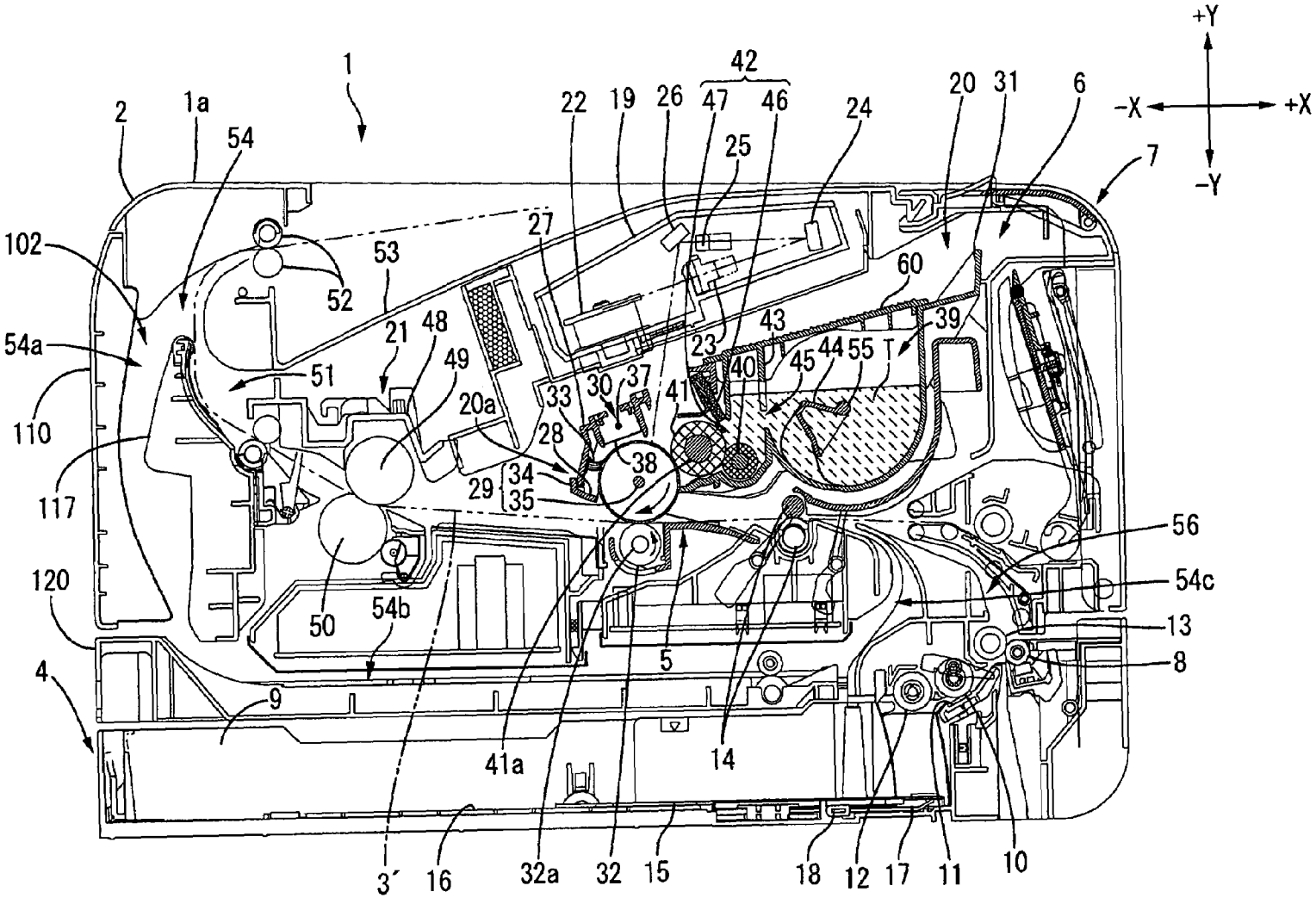
FIG. 1 is a side sectional view of an essential portion showing a laser printer according to a first illustrative aspect of the invention.
Figure 2:
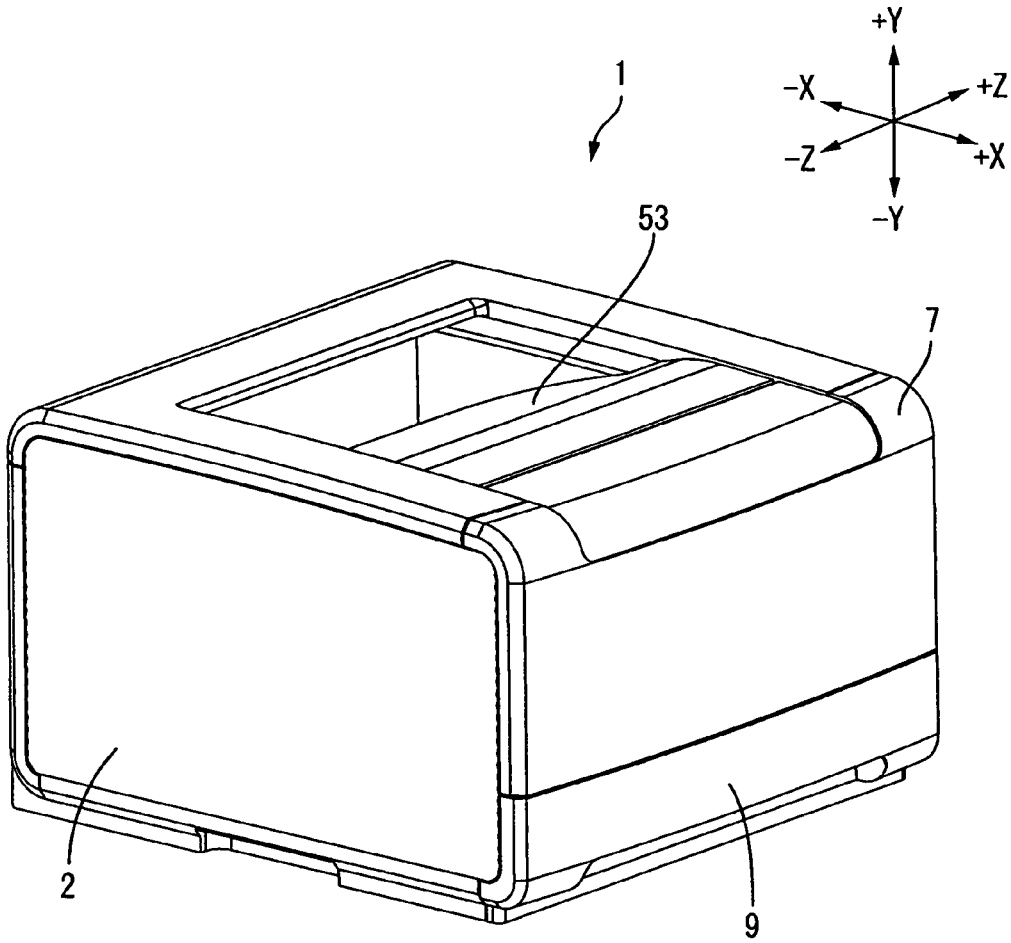
FIG. 2 is a perspective view of the laser printer shown in FIG. 1.

FIG. 1 is a side sectional view of an essential portion showing a laser printer as an image forming apparatus of the invention. Further, FIG. 2 is a perspective view of the laser printer. As shown by FIG. 1, a laser printer 1 is provided with a main body casing 2, a feeder portion 4 contained at inside of the casing 2 for feeding a sheet as a recorded medium, an image forming section 5 for forming an image on the fed sheet. In FIG. 1, a flow of the carried sheet is designated by notation 3'.

(1) Main Body Casing

A side wall on one side of the main body casing 2 is formed with an attaching and detaching port 6 for attaching and detaching a process cartridge 20, mentioned later, and provided with a front cover 7 for opening and closing the attaching and detaching port 6 as shown by FIGS. 1 and 2. The front cover 7 is pivotably supported by a cover shaft inserted to a lower end portion thereof Thereby, when the front cover 7 is closed centering on the cover shaft, as shown by FIG. 1, the attaching and detaching port 6 is closed by the front cover 7, when the front cover 7 is opened (inclined) by constituting a fulcrum by the cover shaft, the attaching and detaching port 6 is opened, and the process cartridge 20 can be attached and detached to and from the main body casing 2 by way of the attaching and detaching port 6.

Further, in the following explanation, in a state of mounting the process cartridge 20 to the main body casing 2, a side that is provided with the front cover 7 (that is, +X side in X axis direction of FIG. 2) is explained as "front side" and a side opposed thereto is explained as "rear side".

(2) Feeder Portion

The feeder portion 4 is provided with a sheet feeding tray 9 attached to and detached from a bottom portion at inside of the main body casing 2, a separating roller 10 and a separating pad 11 provided on an upper side of a front end portion of the sheet feeding tray 9, and a sheet feeding roller 12 provided on a rear side of the separating roller 10 (on an upstream side in the direction of conveying the sheet of the separating pad 11). Further, the feeder portion 4 is provided with a paper powder removing roller 8 arranged opposedly to an upper side of a front side of the separating roller 10 (downstream side in the direction of conveying the sheet of the separating roller), and an opposed roller 13 arranged to be opposed to the paper powder removing roller 8.

Further, a path of conveying the sheet is folded back to a rear side in a U-like shape from a vicinity of arranging the paper powder removing roller 8 and a registration roller 14 comprising a pair of rollers is provided on a lower side of the process cartridge 20 on a further downstream side in the conveying direction.

Inside of the sheet feeding tray 9 is provided with a sheet pressing plate 15 capable of mounting the sheet in a laminated state. The sheet pressing plate 15 is made to be pivotable to a mounting position (a state shown in FIG. 1) at which a front end portion is arranged on a lower side to be along a bottom plate 16 of the sheet feeding tray 9 and an inclined supply position (not illustrated) at which the front end portion is arranged on an upper side by being supported pivotably at a rear end portion thereof.

Further, the front end portion of the sheet feeding tray 9 is provided with a lever 17 for lifting a front end portion of the sheet pressing plate 15 to an upper side. The lever 17 is made to be pivotable between a lie down attitude (a state shown in FIG. 1) at which a front end portion thereof lies down on the bottom plate 16 of the sheet feeding tray 9 and an inclined attitude (not illustrated) at which the front end portion lifts up the sheet pressing plate 15 by pivotably supporting a rear end portion thereof by a lever shaft 18 at a position on a lower side of the front end portion of the sheet pressing plate 15. Further, when a rotational drive force in the counterclockwise direction in the drawing is inputted to the lever shaft 18, the lever 17 is rotated by constituting a fulcrum by the lever shaft 18, the front end portion of the lever 17 lifts up the front end portion of the sheet pressing plate 15 and the sheet pressing plate 15 is moved to a supply position.

When the sheet pressing plate 15 is disposed at the supply position, a sheet on the sheet pressing plate 15 is pressed to the sheet feeding roller 12 and the sheet is started to be fed to a separating portion between the separating roller 10 and the separating pad 11 by rotating the sheet feeding roller 12.

On the other hand, when the sheet feeding tray 9 is detached from the main body casing 2, a front side end portion of the sheet pressing plate 15 is moved to a lower side by a self weight thereof and the sheet pressing plate 15 is disposed at a mounting position. When the sheet pressing plate 15 is disposed at the mounting position, sheets can be mounted on the sheet pressing plate 15 in a laminated state. Further, the separating pad 11, the paper powder removing roller 8, the sheet pressing plate 15 and the lever 17 are provided at the sheet feeding tray 9, and the sheet feeding roller 12, the separating roller 10, the opposed roller 13 and the registration roller 14 are provided at the main body casing 2.

When a sheet fed to the separating position by the sheet feeding roller 12 is pinched between the separating roller 10 and the separating pad 11 by rotating the separating roller 10, the sheet is fed by being separated sheet by sheet. The fed sheet is folded back along the conveying path 56 in the U-like shape. Further specifically, the fed sheet is first carried to an upper side by passing between the separating roller 10 and the separating pad 11 and is carried to the registration roller 14 after passing further between the paper powder removing roller 8 and the opposed roller 13 to remove paper powders.

The registration roller 14 carries the sheet to a transcribing position between a photosensitive drum 29 and a transcribing roller 32 for transcribing a toner image on the photosensitive drum 29 onto the sheet.

(3) Image Forming Section

The image forming section 5 is provided with a scanner portion 19, the process cartridge 20, a fixing portion 21 and the like.

(a) Scanner Portion

The scanner portion 19 is provided at an upper portion at inside of the main body casing,2 and is provided with a laser beam source, not illustrated, a polygonal mirror 22 which is driven to rotate, an fθ lens 23, a reflecting mirror 24, a lens 25 and a reflecting mirror 26 and the like. As indicated by a chain line, a laser beam based on image data emitted from the laser beam source is deflected by the polygonal mirror 22, passes through the fθ lens 23, and an optical path thereof is folded back by the reflecting mirror 24, the laser beam further passes through the lens 25 and thereafter, the optical path is further flexed to a lower side by the reflecting mirror 26, thereby, the laser beam is irradiated onto a surface of the photosensitive drum 29, mentioned later, of the process cartridge 20.

(b) Process Cartridge

The process cartridge 20 is mounted attachably and detachably to and from the main body casing 2 on a lower side of the scanner portion 19. The process cartridge 20 is provided with an upper frame 27, and a lower frame 28 formed separately from the upper frame 27 and combined with the upper frame 27 as a drum cartridge 20*a*. Further, the process cartridge 20 is provided with the photosensitive drum 29 as an image carrier, a scorotron type charger 30 as charging means, a developing cartridge 31, the transcribing roller 32 as transcribing means, a cleaning brush 33.

The photosensitive drum 29 is provided with a drum main body 34 which includes a cylindrical shape and a topmost layer of which is formed by appositively charging photosensitive layer comprising polycarbonate or the like, and a drum shaft 35 made of a metal as a shaft extended along a longitudinal direction of the drum main body 34 at an axis center of the drum main body 34. By supporting the drum shaft 35 by the upper frame 27 and rotatably supporting the drum main body 34 by the drum shaft 35, the photosensitive drum 29 is rotatably provided centering on the drum shaft 35 in the upper frame 27.

The scorotron type charger 30 is supported by the upper frame 27 and arranged to be opposed to the photosensitive drum 29 to be spaced apart from each other a predetermined interval therebetween so as not to be brought into contact with the photosensitive drum 29. The scorotron type charger 30 is provided with a discharging wire 37 arranged to be opposed to the photosensitive drum 29 to be spaced apart from each other by a predetermined interval therebetween, and a grid 38 provided between the discharging wire 37 and the photosensitive drum 29 for controlling an amount of discharging electricity from the discharging wire 37 to the photosensitive drum 29. The scorotron type charger 30 can uniformly and positively charge a surface of the photosensitive drum 29 by discharging the discharging wire 37 by applying a high voltage to the discharging wire 37 simultaneously with applying a bias voltage to the grid 38.

The developing cartridge 31 is provided with a containing case 60 in a box-like shape a rear side of which is opened and is mounted attachably and detachably to and from the lower frame 28. Inside of the developing cartridge 31 is provided with a toner containing chamber 39, a toner supply roller 40, a developing roller 41 and a layer thickness restricting blade 42.

The toner containing chamber 39 is formed as an inner space on a front side of the developing cartridge 31 partitioned by a partitioning plate 43. Inside of the toner containing chamber 39 is filled with a toner T of a positively charging nonmagnetic single component. As the toner T, there is used a polymerized toner by polymerizing a polymerizing monomer, for example, a styrene species monomer of styrene or the like, acrylic species monomer of acrylic acid, alkyl (C1 through C4) acrylate, alkyl (C1 through C4) metaacrylate or the like by suspension polymerization or the like. Such a polymerized toner is constituted substantially by a spherical shape, extremely excellent in a fluidity and can achieve to form an image having a high image quality.

Further, a toner is blended with a colorant of carbon black or the like or wax or the like, further, added with an externally added agent of silica or the like to promote the fluidity. A mean particle size of the toner is about 6 through 10 μm.

Further, inside of the toner containing chamber 39 is provided with an agitator 44 supported by a rotating shaft 55 provided at a center thereof. The agitator 44 is driven to rotate by inputting power from a motor, not illustrated. When the agitator 44 is driven to rotate, the toner T at inside of the toner containing chamber 39 is agitated and discharged to the toner supply roller 40 from an opening portion 45 communicated in a front and rear direction on a lower side of a partitioning plate 43. Further, two left and right side walls of the containing case 60 are mounted with window members (not illustrated) at regions respectively in correspondence with the toner containing chamber 39. The respective window members are cleaned by wipers held and cooperatively moved by the agitator 44. Further, the main body casing 2 is provided with a light emitting element (not illustrated) on an outer side of one of the window members and a light receiving element (not illustrated) on an outer side of other of the window members, and detecting light emitted from the light emitting element and passing inside of the containing case 60 is detected by the light receiving element and presence or absence of the toner T is determined in accordance with an output value thereof.

The supply roller 40 is arranged on a rear side of the opening portion 45 and is rotatably supported by the developing cartridge 31. The supply roller 40 includes covering a roller shaft made of a metal by a roller comprising a conductive foamed material. The supply roller 40 is driven to rotate by inputting power from a motor, not illustrated.

The developing roller 41 is rotatably supported by the developing cartridge 31 in a state of being brought into contact with the toner supply roller 40 to be compressed by each other on a rear side of the toner supply roller 40. Further, the developing roller 41 is opposed to be brought into contact with the photosensitive drum 29 in a state of mounting the developing cartridge 31 to the lower frame 28. The developing roller 41 includes covering a roller shaft 41*a* made of a metal by a roller comprising a conductive rubber material. Both end portions of the roller shaft 41*a* are projected to outer sides in a width direction orthogonal to a front and rear direction from side faces of the developing cartridge 31 at a front end portion of the developing cartridge 31. A roller of the developing roller 41 is coated with a coating layer of urethane rubber or silicone rubber including fluorine on a surface of a roller main body comprising conductive urethane rubber or silicone rubber including a fine carbon powder. The developing roller 41 is applied with a developing bias in developing. Further, the developing roller 41 is driven to rotate in a direction the same as that of the toner supply roller 41 by inputting power from a motor, not illustrated.

The layer thickness restricting blade 42 is provided with a pressing portion 47 having a section in a semicircular shape comprising insulting silicone rubber at a front end portion of the blade main body 46 comprising a metal leaf spring member. The layer thickness restricting blade 42 is supported by the developing cartridge 31 on an upper side of the developing roller 41 and the pressing-portion 47 is brought into press contact with the developing roller 41 by an elastic force of the blade main body 46.

A toner discharged from the opening portion 45 is supplied to the developing roller 41 by rotating the toner supply roller 40 and is charged positively by a friction between the toner supply roller 40 and the developing roller 41 at this occasion. The toner supplied onto the developing roller 41 advances to between the pressing portion 47 of the layer thickness restricting blade 42 and the developing roller 41 in accordance with rotation of the developing roller 41 and is carried on the developing roller 41 as a thin layer having a constant thickness.

The transcribing roller 32 is rotatably supported by the lower frame 28, opposed to be brought into contact with the photosensitive drum 29 in an up and down direction in a state of combining the upper frame 27 and the lower frame 28 and arranged to form a nip between the transcribing roller 32 and the photosensitive drum 29. The transcribing roller 32 includes covering a roller shaft made of a metal by a roller comprising a conductive rubber material. The transcribing roller 32 is applied with a transcribing bias in transcribing. The transcribing roller 32 is driven to rotate in a direction inverse to that of the photosensitive drum 29 by inputting power from a motor, not illustrated.

The cleaning brush 33 is attached to the upper frame 27 and is arranged to be opposed to be brought into contact with the photosensitive drum 29 on a rear side of the photosensitive drum 29 in a state of combining the upper frame 27 and the lower frame 28.

The surface of the photosensitive drum 29 is, first, uniformly charged positively by the scorotron type charger 30 in accordance with rotation of the photosensitive drum 29 and thereafter exposed by high speed scanning of the laser beam from the scanner portion 19 and is formed with an electrostatic latent image in correspondence with an image to be formed on the sheet 3.

Next, when the toner carried on the developing roller 41 and charged positively is opposed to be brought into contact with the photosensitive drum 29 by rotating the developing roller 41, the toner is supplied to the exposed portion formed on the surface of the photosensitive drum 29, that is, an exposed portion which is exposed by the laser beam and a potential of which is lowered in the surface of the photosensitive drum 29 uniformly charged positively. Thereby, the electrostatic latent image of the photosensitive drum 29 is visualized and a toner image by inversion development is carried on the surface of the photosensitive drum 29.

Thereafter, as shown by FIG. 1, the toner image carried on the surface of the photosensitive drum 29 is transcribed onto the sheet 3 by the transcribing bias applied to the transcribing roller 32 during a time period in which the sheet 3 carried by the registration roller 14 passes a transcribing portion between the photosensitive drum 29 and the transcribing roller 32. The sheet 3 transcribed with the toner image is carried to the fixing portion 21.

Further, a remaining toner of transcription which remains on the photosensitive drum 29 after transcription is recovered by the developing roller 41. Further, paper powder from the sheet 3 adhered onto the photosensitive drum 29 after transcription is recovered by the cleaning brush 33.

(c) Fixing Portion

The fixing portion 21 is provided on a rear side of the process cartridge 20 and is provided with a fixing frame 48 and a heating roller 49 and a pressing roller 50 at inside of the fixing frame 48.

The heating roller 49 is provided with a metal tube a surface of which is coated by fluororesin and a halogen lamp for heating at inside of the metal tube and is driven to rotate by inputting power from a motor, not illustrated. On the other hand, the pressing roller 50 is arranged on a lower side of the heating roller 49 to be opposed thereto to press the heating roller 49. The pressing roller 50 includes coating a roller shaft made of a metal by a roller comprising a rubber material and is driven by driving to rotate the heating roller 49.

At the fixing portion 21, the toner transcribed onto the sheet at the transcribing position is thermally fixed during a time period of passing the sheet between the heating roller 49 and the pressing roller 50. The sheet fixed with the toner is carried to a sheet discharging path 51 extended in an up and down direction to an upper face of the main body casing 2. The sheet carried to the sheet discharging path is discharged onto a sheet discharge tray 53 formed at an upper face of the main body casing 2 by a sheet discharge roller 52 provided on an upper side thereof.

(4) Double Face Printed Image Forming Unit

According to the illustrative aspect, double face printed image forming unit is configured by including the above-described sheet discharge roller 52 and a duplex printing conveying path 54. The sheet discharge roller 52 comprises a pair of rollers and is constituted to be able to switch regular rotation and inverse rotation. The sheet discharge roller 52 is rotated in a regular direction when a sheet is discharged onto the sheet discharge tray 53 and rotated in an inverse direction and the sheet is inversely rotated.

The duplex printing conveying path 54 is configured by a configuration including a first conveying path **54*a* for conveying the sheet from a vicinity of an upper end of a cover member 110 to a vicinity of a tray member 120, a second conveying path 54*b* for conveying the sheet along the tray member 120 arranged on a lower side of the image forming unit 5, and a third conveying path 54*c* in a U-like shape for conveying the sheet from a vicinity of a front end of the tray member 120 to a vicinity of the registration roller 14. The duplex printing conveying path 54 is constituted as a reconveying path for inverting a front face and a back face of the sheet formed with an image on one face thereof by the image forming section 5 and thereafter conveying the sheet again to the image forming section 5**.

Further, when images are formed on both faces of the sheet, the double face printed image forming unit is operated as follows. That is, when a sheet formed with an image on one face thereof is carried from the sheet discharging path 51 to the sheet discharge roller 52, the sheet discharge roller 52 is rotated regularly in a state of pinching the sheet to carry the sheet temporarily to an outer side (side of the sheet discharging tray 53) and when most of the sheet is carried to the outer side and a rear end of the sheet 3 is pinched by the sheet discharging roller 52 as shown by FIG. 1, regular rotation is stopped. Successively, the sheet discharging roller 52 is inversely rotated and the sheet is carried to the duplex printing conveying path 54 in a state of being directed inversely in the front and rear direction. The sheet carried to the duplex printing conveying path 54 in the inverse direction is inverted to invert a front face and a back face thereof during a time period of passing the duplex printing conveying path and is carried to the registration roller 14. The sheet carried to the registration roller 14 by passing the duplex printing conveying path 54 is carried again in an upside down state to the image forming section 5 after predetermined registration, thereby, predetermined images are formed on the both faces of the sheet.

(5) Guide Member

Next, a guide member constituting the duplex printing conveying path 54 will be explained.

Figure 3:
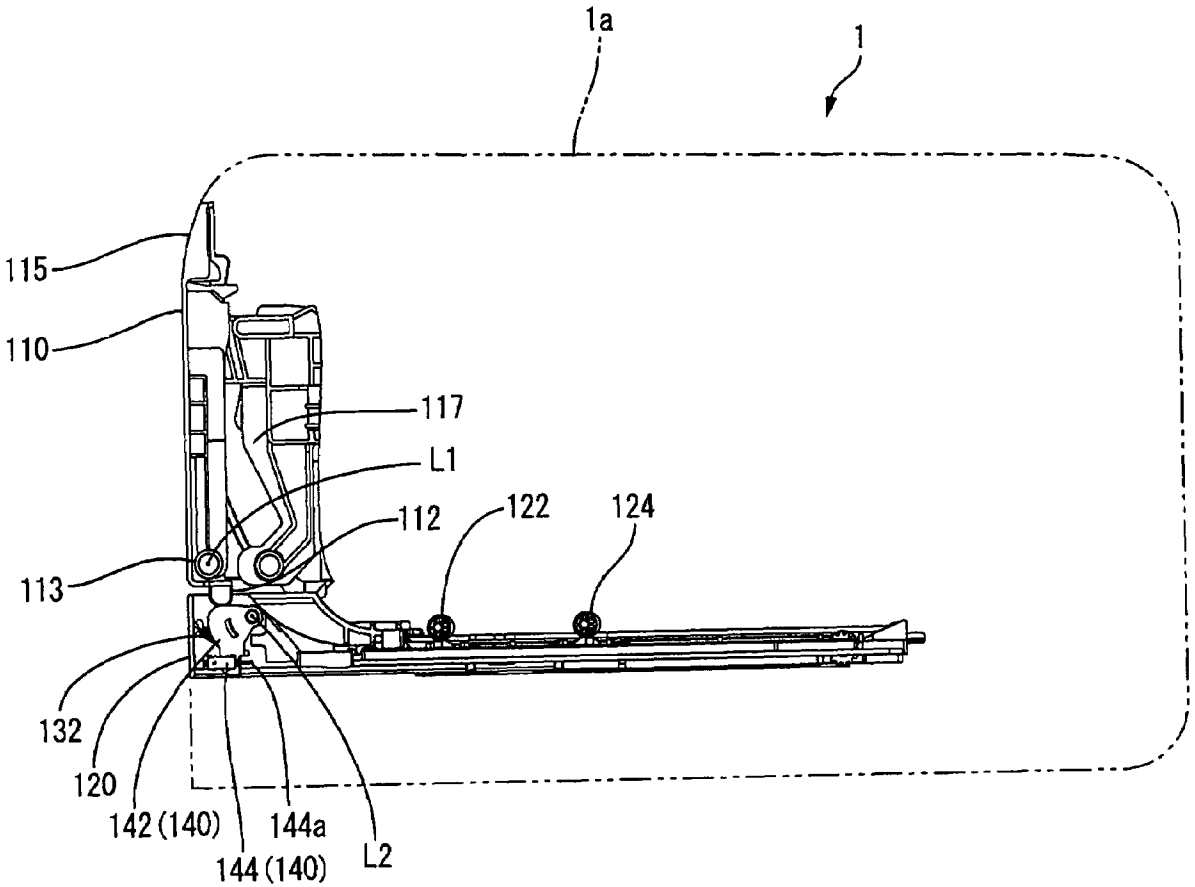
FIG. 3 is a view showing a portion of a duplex printing path and is a view showing a state of removing a main body casing with regard to a portion of the laser printer.
Figure 4:
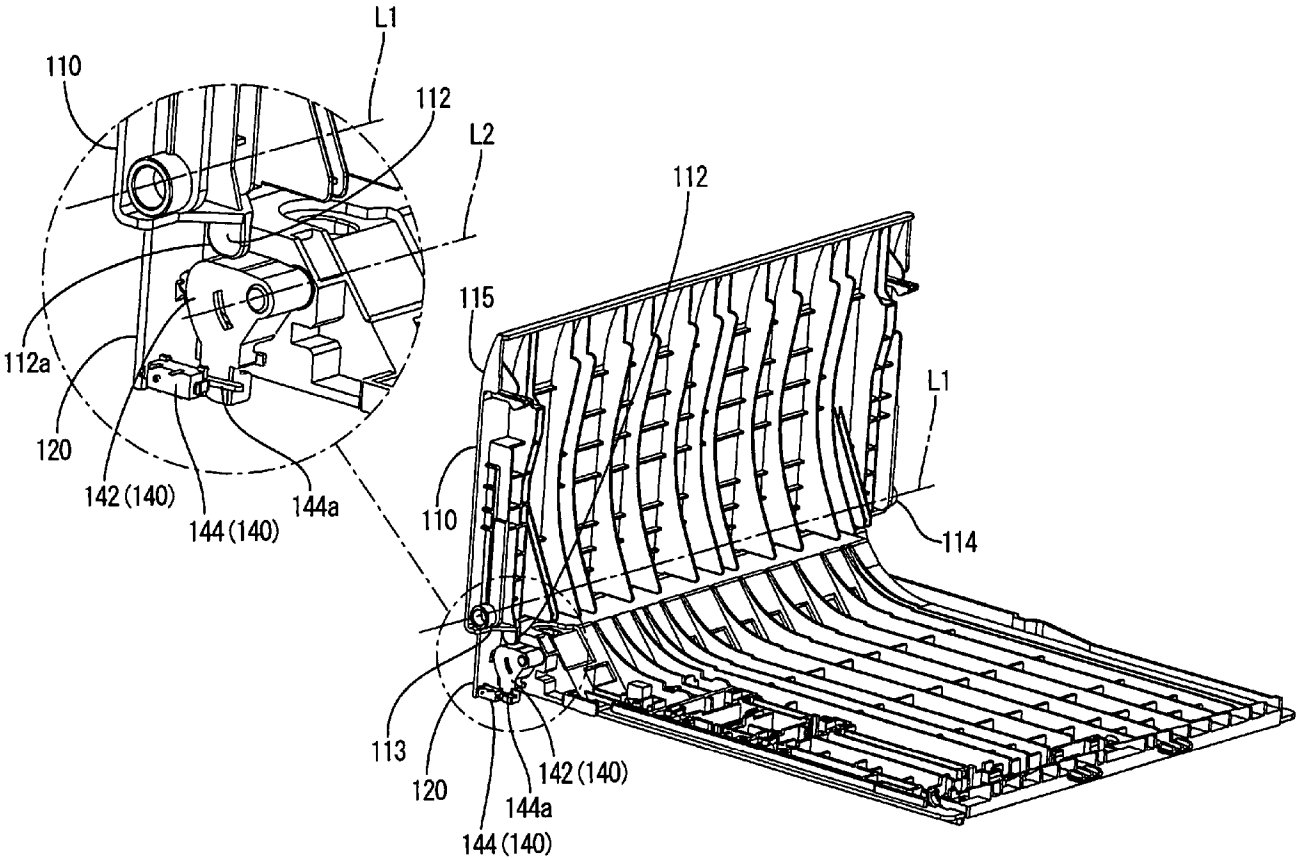
FIG. 4 is a perspective view showing a state in correspondence with FIG. 3 with regard to a cover member and a tray member.
Figure 5:
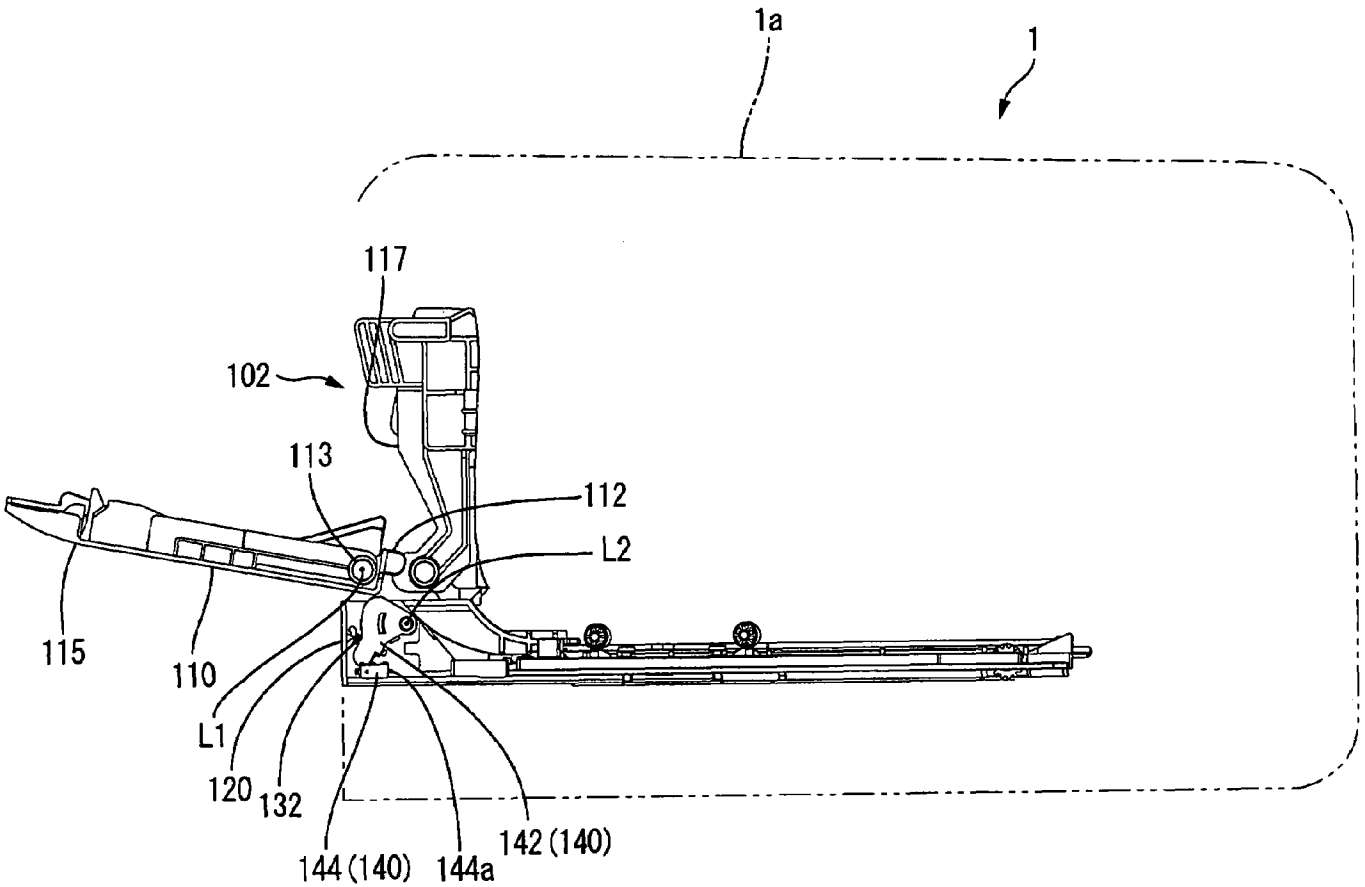
FIG. 5 is a view showing a state of displacing only the cover member from a state of FIG. 3 and is an explanatory view showing an example of opening the cover member in a state of attaching the tray member.
Figure 6:
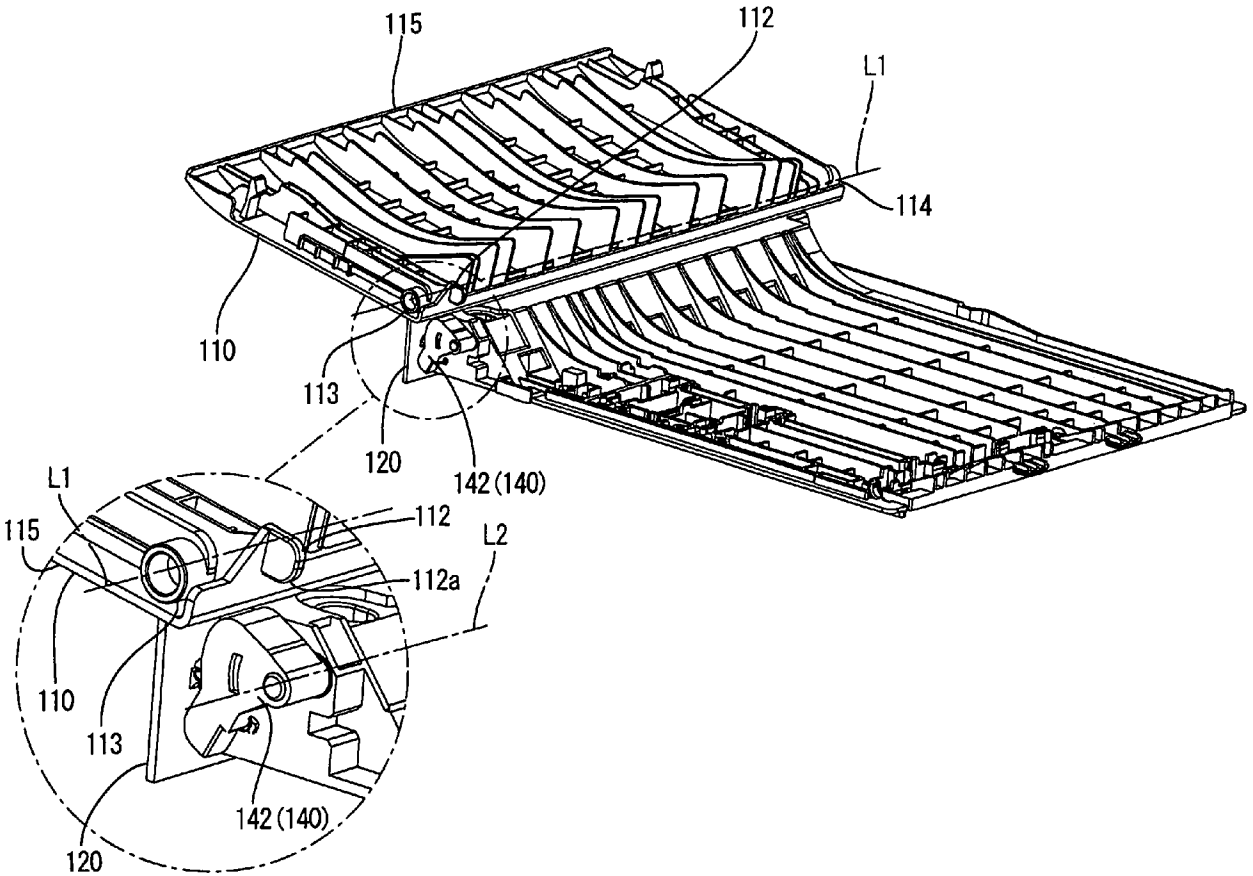
FIG. 6 is a perspective view showing a state in correspondence with FIG. 5 with regard to the cover member and the tray member.
Figure 7:
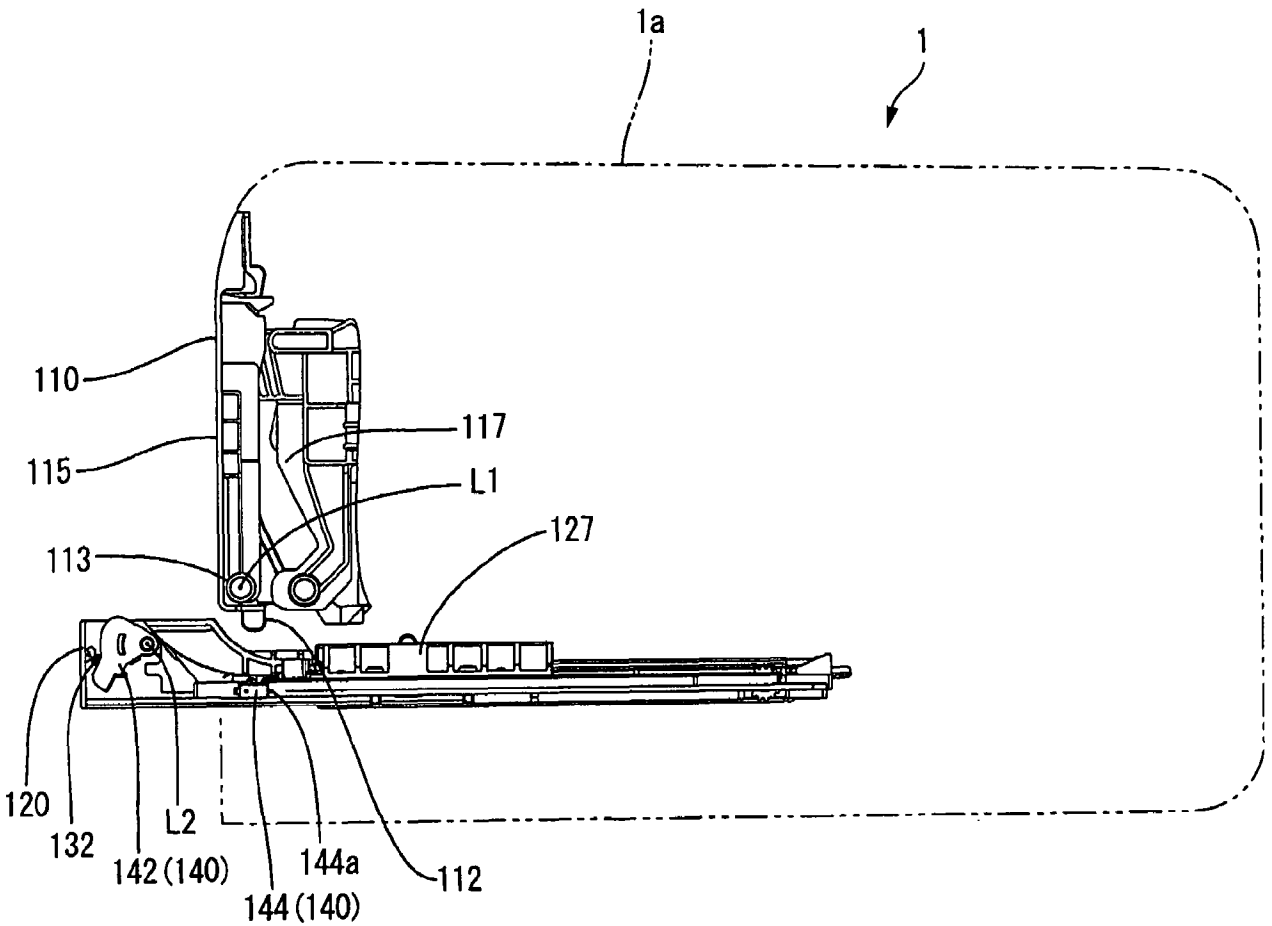
FIG. 7 is a view showing a state of displacing the tray member from a state of FIG. 3 and is an explanatory view showing a state of detaching only the tray member while closing the cover member.
Figure 8:
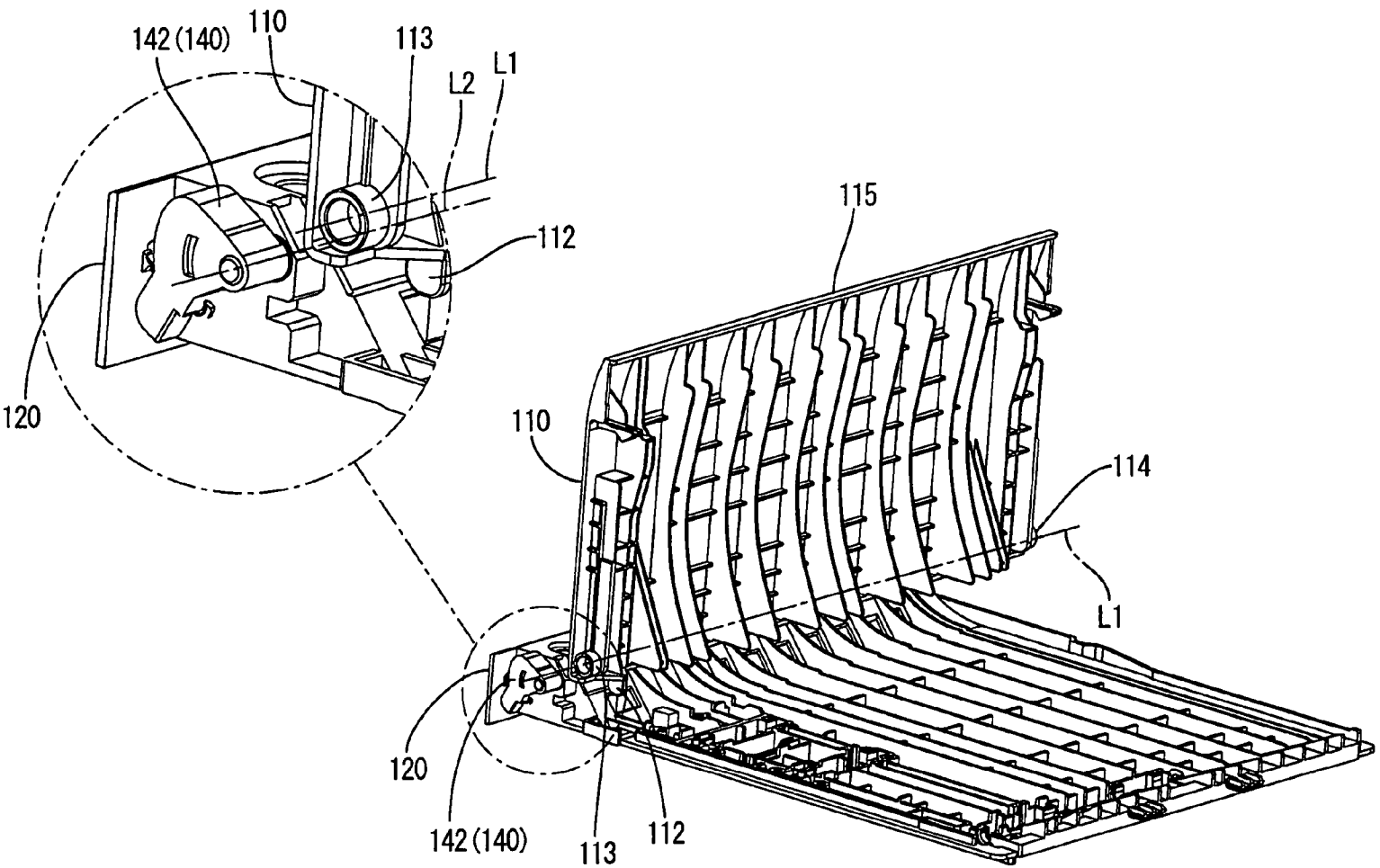
FIG. 8 is a perspective view showing a state in correspondence with FIG. 7 with regard to the cover member and the tray member.

FIG. 3 is a view showing a portion of the duplex printing conveying path 54, showing a portion of the printer 1 in a state of removing the main body casing 2 (further specifically, a state of removing a side wall in −Z direction) from a side direction. FIG. 4 is a perspective view showing a state in correspondence with FIG. 3 with regard to a cover member and a tray member. FIG. 5 is a view showing a state of displacing only the cover member 110 and is an explanatory view showing an example of opening the cover member 110 in a state of attaching the tray member 120. FIG. 6 is a perspective view showing a state in correspondence with FIG. 5 with regard to the cover member and the tray member. FIG. 7 is a view showing a state of displacing the tray member 120 from FIG. 3 and is an explanatory view showing a state of detaching only the tray member 120 while closing the cover member 110. FIG. 8 is a perspective view showing a state in correspondence with FIG. 7 with regard to the cover member and the tray member. In FIGS. 6 and 8, a sensor device 144 is omitted.

As shown by FIGS. 3 and 4, the duplex printing conveying path 54 is configured by including the cover member 110 (the cover member 110 corresponds to a first guide member) configured to be openable and closable and the tray member 120 (the tray member 120 corresponds to a second guide member) configured to be attachable to and detachable from the main body casing 2. The cover member 110 constitutes the first conveying path **54*a*** along with an opposed member 117 and the tray member 120 constitutes the second conveying path 54*b* by including roller members 122, 124 constituted drivably. FIGS. 3 and 5 are illustrated by excluding a wall portion 127 (refer to FIG. 7) formed at a main body portion of the tray member 120 for holding the roller members 122, 124.

Further, according to the laser printer 1, a position of closing the opening portion 102 as shown by FIGS. 1, 3 and 4 is made to constitute a normal guide position of the cover member 110 in forming an image. As shown by FIGS. 1, 3 and 4, a state of normally attaching the tray member 120 is made to constitute a normal guide position of the tray member 120 in forming an image.

As shown by FIG. 5 and 6, the cover member 110 is constituted to open and close an opening portion 102 communicating with the duplex printing conveying path 54 in a face (that is, face on a rear side) on a side opposed to a face (that is, face on a front side) on a side of drawing out the sheet feeding tray 9 (refer to FIG. 1) in an apparatus main body 1*a*. Further, in the specification, "apparatus main body" indicates a main body portion excluding the cover member and the tray member from the image forming apparatus. The cover member 110 includes a closing portion 115 for closing the opening portion 102, configured such that end portions 113, 114 on a lower end side thereof are pivotably supported by the apparatus main body 1*a* and configured to be pivotable by having a pivoting center by an axis line L1 in correspondence with a supporting position. Further, the opening portion 102 is opened and closed in accordance with pivoting the cover member 110.

As shown by FIGS. 7 and 8, the tray member 120 is provided to be contiguous to the cover member 110 on a lower side of the cover member and is constituted to be attachable to and detachable from the apparatus main body 1*a*. Specifically, the tray member 120 is constituted to be able to be drawn out in a direction (−X direction) that is, rear direction (FIG. 1) on a side inverse to a direction of drawing out the sheet feeding tray 9 (+X direction (that is, front direction) in FIG. 1) at a face on a side inverse to a face on a side of drawing out the sheet feeding tray 9 (FIG. 1) (that is, a face on a rear side).

Figure 9A:
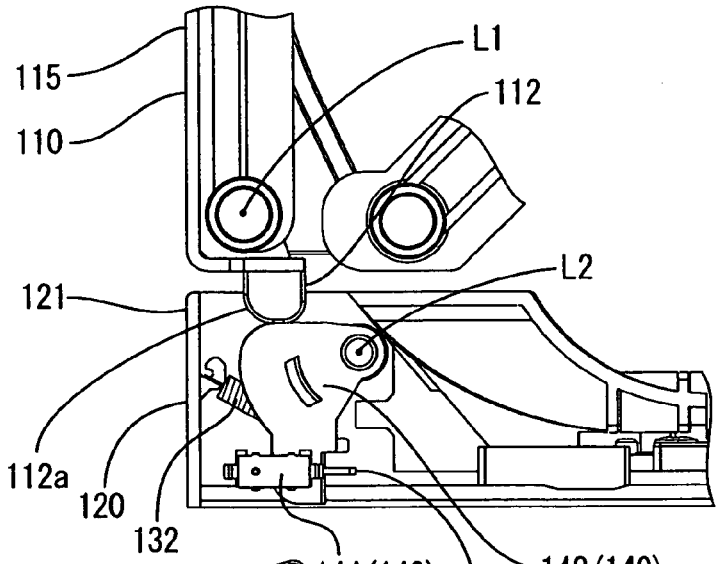
FIGS. 9A-9C illustrate enlarged views enlarging to show an essential portion shown in FIGS. 3, 5 and 7.
Figure 9B:
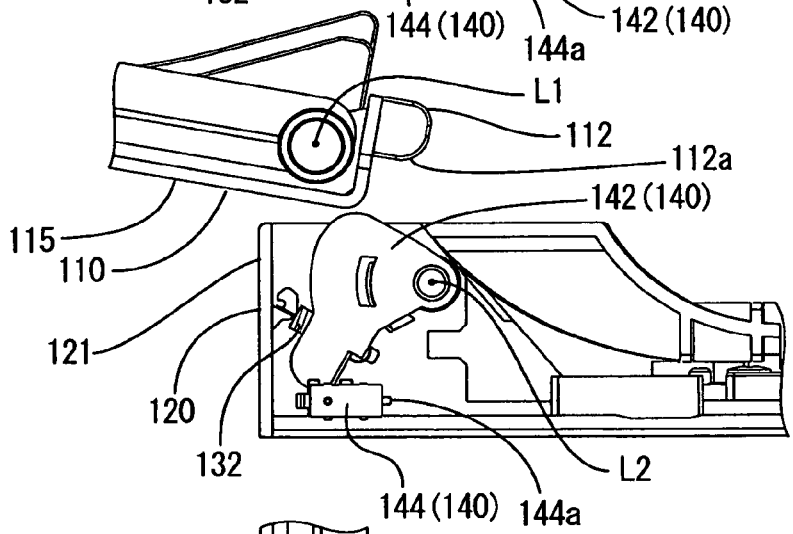
Figure 9C:
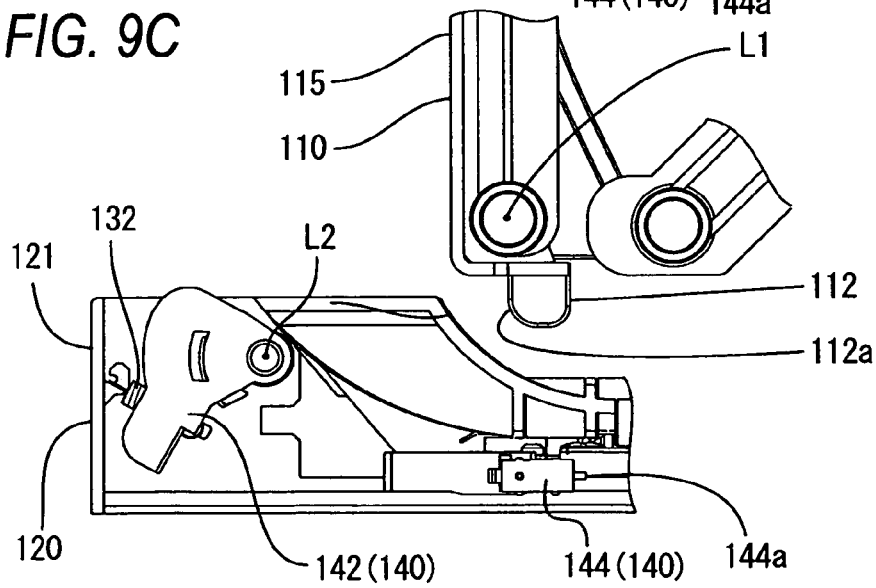

Next, detecting units will be explained. FIGS. 9A-9C are enlarged view enlarging to show essential portions shown in FIGS. 3, 5 and 7.

The laser printer 1 according to the illustrative aspect is provided with a single detecting units 140 capable of detecting that both of the cover member 110 and the tray member 120 are disposed at the normal guide positions in the duplex printing conveying path 54. As shown in FIG. 9A, the detecting units 140 includes a displacing member 142 displaced in conjunction with displacements of the cover member 110 and the tray member 120 and a sensor device 144 for detecting a displacement of the displacing member 142.

The displacing member 142 is pivotably supported by a main body portion 121 of the tray member 120, and is constituted to be able to displace to a first position when both of the cover member 110 and the tray member 120 are disposed at the normal guide positions as shown by FIG. 9A (that is, a state shown in FIGS. 3 and 4) and a second displacement position when at least either of the cover member 110 and the tray member 120 is brought into an abnormal state as shown in FIGS. 9B and 9C (that is, a state in which either thereof is not disposed at the normal guide position) (that is, a state shown in any one of FIGS. 5-8).

Specifically, the displacing member 142 is supported by the main body portion 121 of the tray member 120 to be pivotable centering on an axis line L2. The displacing member 142 is mounted with a spring member 132 as urging member, as shown in FIGS. 9B or 9C, in a state in which the displacing member 142 is not operated with operation by a press operating portion 112, mentioned later, the spring member 132 is brought into a natural state as shown in FIGS. 9B and 9C and the displacing member 142 is maintained at the second displacement position in correspondence therewith.

As shown in FIG. 9A, the cover member 110 is provided with the press operating portion 112 for pressing the displacing member 142. The press operating portion 112 is provided to project to a side opposed to a closing portion 115 of the cover member 110 relative to the pivoting axis line L1. The press operating portion 112 is constituted to press the displacing member 142 against urging by the spring member 132 when the tray member 120 is held at the normal guide position as shown by FIG. 9A, in such a state in which the press operating portion 112 continues pressing the displacing member 142, the displacing member 142 continues to be maintained at the first displacement position. Further, the press operating portion 112 is formed with a faced portion 112*a* for guiding the displacing member 142 when the press operating portion 112 is brought into contact with the displacing member 142.

Further, the sensor device 144 constituting a portion of the detecting units 140 is provided at the apparatus main body 1*a*. Although in FIGS. 9A-9C, a configuration of a holding portion for holding the sensor device 144 is not illustrated, as is known from FIGS. 9A and 9C, the tray member 120 is constituted to move relative to the sensor device 144 held by the apparatus main body 1*a*. Further, according to the illustrative aspect, the displacing member 142 is maintained at a position of being able to be detected by the sensor device 144 only when the tray member 120 is disposed at the normal position as shown by FIG. 9A. Further, the displacing member 142 is operated normally by the press operating portion 112 (that is, the displacing member 142 is operated to displace up to the first displacement position) only when the tray member 120 is disposed at the normal position and is displaced to a position of being able to be detected by the sensor device 144 as shown by FIG. 9A only when the cover member 110 is closed in a state in which the tray member 120 is disposed at the normal position in this way.

Conversely, when the tray member 120 is not disposed at the normal position as shown by FIG. 9C, the displacing member 142 is separated from the detecting position by the sensor device 144 and therefore, detection by the sensor device 144 is not carried out. Further, in a state in which the cover member 110 is opened as shown by FIG. 9B, the displacing member 142 is not operated by the press operating portion 110 and therefore, the displacing member 142 is not displaced to the first displacement position and the detection by the sensor device 144 is not carried out.

The sensor device 144 is provided with an inclinable lever 144*a* and is constituted such that when the displacing member 142 constituted as described above is disposed at the first displacement position, the lever 144*a* is inclined to output a detecting signal and when the displacing member 142 is disposed at the second displacement position, the lever 144*a* is not inclined and the detecting signal is not outputted. According to the illustrative aspect, the senor member 144 is provided at the apparatus main body 1*a* and therefore, a configuration for connecting the sensor device 144 and various boards (configuration of wiring or the like) can be simplified. Further, here, although there is exemplified the sensor device 144 for conveying out the detection by inclining the lever 144*a* in accordance with the displacement of the displacing member 142, the sensor may be an optical sensor of photoelectric sensor or the like for detecting a state in which the displacing member 142 is disposed at the first displacement position. Further, the sensor may be other sensor so far as the senor is a sensor capable of detecting to differentiate the first displacement position and the second displacement position.

Further, the tray member 120 according to the illustrative aspect can be detached as shown by FIG. 9C in a state of closing the cover member 110 as shown by FIG. 9A, further, even when the tray member 120 is detached in the state of closing the cover member 110 as shown by FIG. 9C, the tray member 120 can be attached thereto while the cover member 110 stays to be closed. On the other hand, the cover member 110 is constituted to be able to be opened as shown by FIG. 9B in a state of attaching the tray member 120 as shown by FIG. 9A and even when the cover member 110 is opened in the state of attaching the tray member 120 as shown by FIG. 9B, the cover member 120 can be closed while the tray member 120 stays to be attached. However, when either one member of the cover member 110 and the tray member 120 constituting the conveying path is disposed at the normal position, while maintaining the normal position of the one member, other member can be displaced independently therefrom.

Specifically, when the cover member 110 is opened and closed in the state of attaching the tray member 120 as shown by FIG. 9B, although a portion of the displacing member 142 is disposed on a path of moving the press operating portion 112 in accordance with opening and closing the cover member 110, the displacing member 142 is constituted to escape outside of the path of moving the press operating portion by being pressed by the press operating portion 112 in opening and closing the cover member 110 as shown by FIG. 9A. For example, when the cover member 110 is closed from the state of FIG. 9B, by pressing the displacing member 142 to the press operating portion 112 as shown by FIG. 9A, the portion of the displacing member 142 is escaped outside of the path of moving the press operating portion 112. At this occasion, the displacing member 142 is escaped to outside of the path of moving the press operating portion 112 by being guided by the faced portion 112*a* formed at the press operating portion 112.

When the tray member 112 is attached and detached in the state of closing the cover member 110 as shown by FIG. 9C, the press operating portion 112 is disposed on the path of moving the displacing member 142 moved cooperatively with the tray member 120, however, the displacing member 142 is displaced to take a path of moving to escape from a position of interfering with the press operating portion 112 by being pressed by the press operating portion 112 in accordance with movement cooperative with the tray member 120. Specifically, when the displacing member 142 becomes proximate to the press operating portion 112, the displacing member 142 is moved at a surrounding of the press operating portion 112 while being brought into contact with the press operating portion 112. For example, when the tray member 120 is inserted from the state shown by FIG. 9C, the displacing member 142 is displaced to be escaped from a position of interfering with the press operating portion 112 as shown by FIG. 9A. Also in this case, the displacing member 142 is escaped from the position interfering with the press operating portion 112 by being guided by the faced portion 112*a* formed at the press operating portion 112.

Therefore, even when the cover member 110 is opened and closed in the state of attaching the tray member 120, or even when the tray member 120 is attached and detached in the state of closing the cover member 110, the displacing member 142 and the press operating portion 112 do not hamper movements of counterparts thereof. Thereby, even when the cover member 110 is operated independently and even when the tray member 120 is operated independently, the operation is not failed by interference between the press operating portion 112 and the displacing member 142 to thereby provide an extremely excellent way of use.

Second Illustrative Aspect

Next, a second illustrative aspect will be explained in reference to FIGS. 10 and 11.

Figure 10:
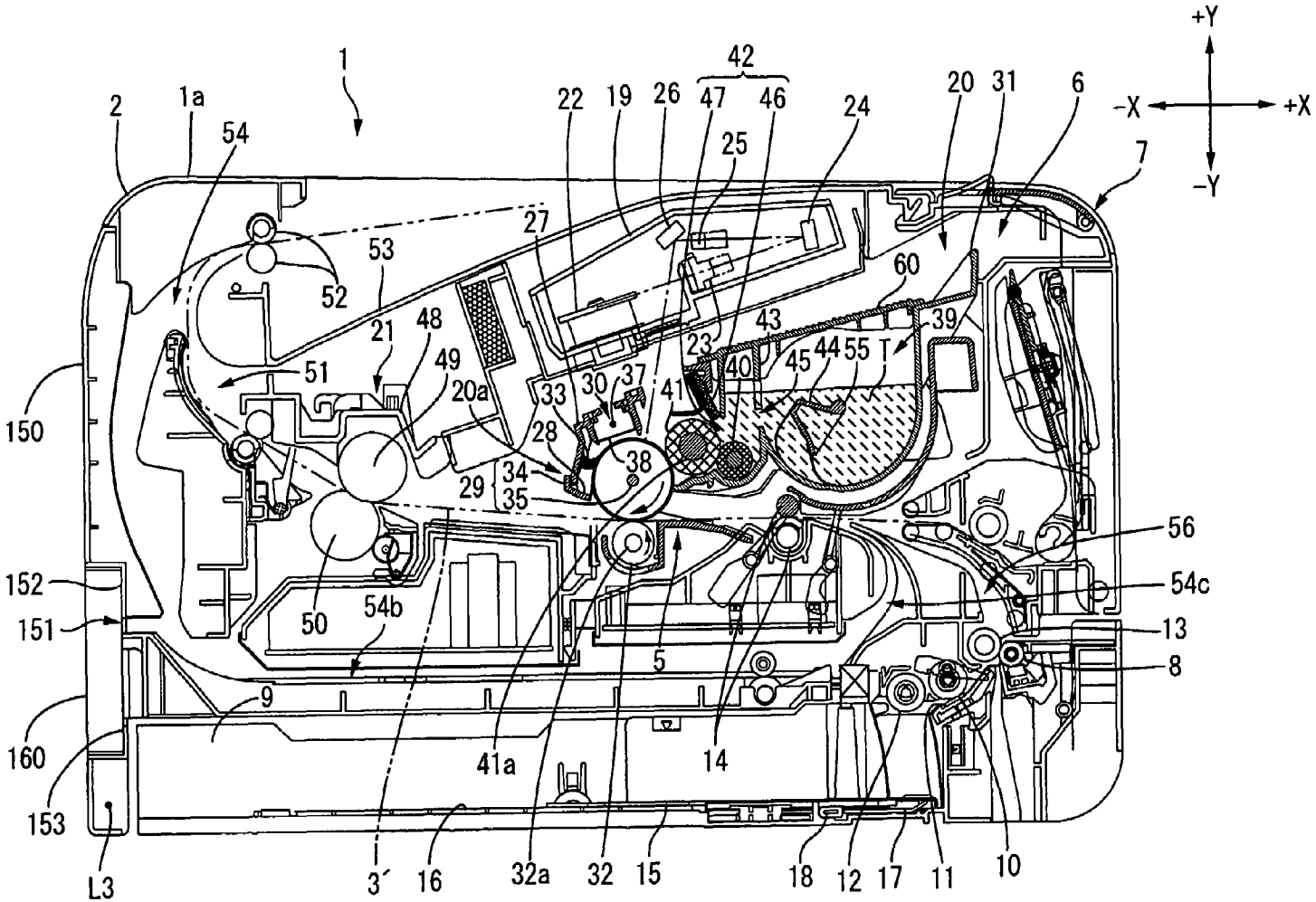
FIG. 10 is a side sectional view of an essential portion showing a laser printer according to a second illustrative aspect.
Figure 11:
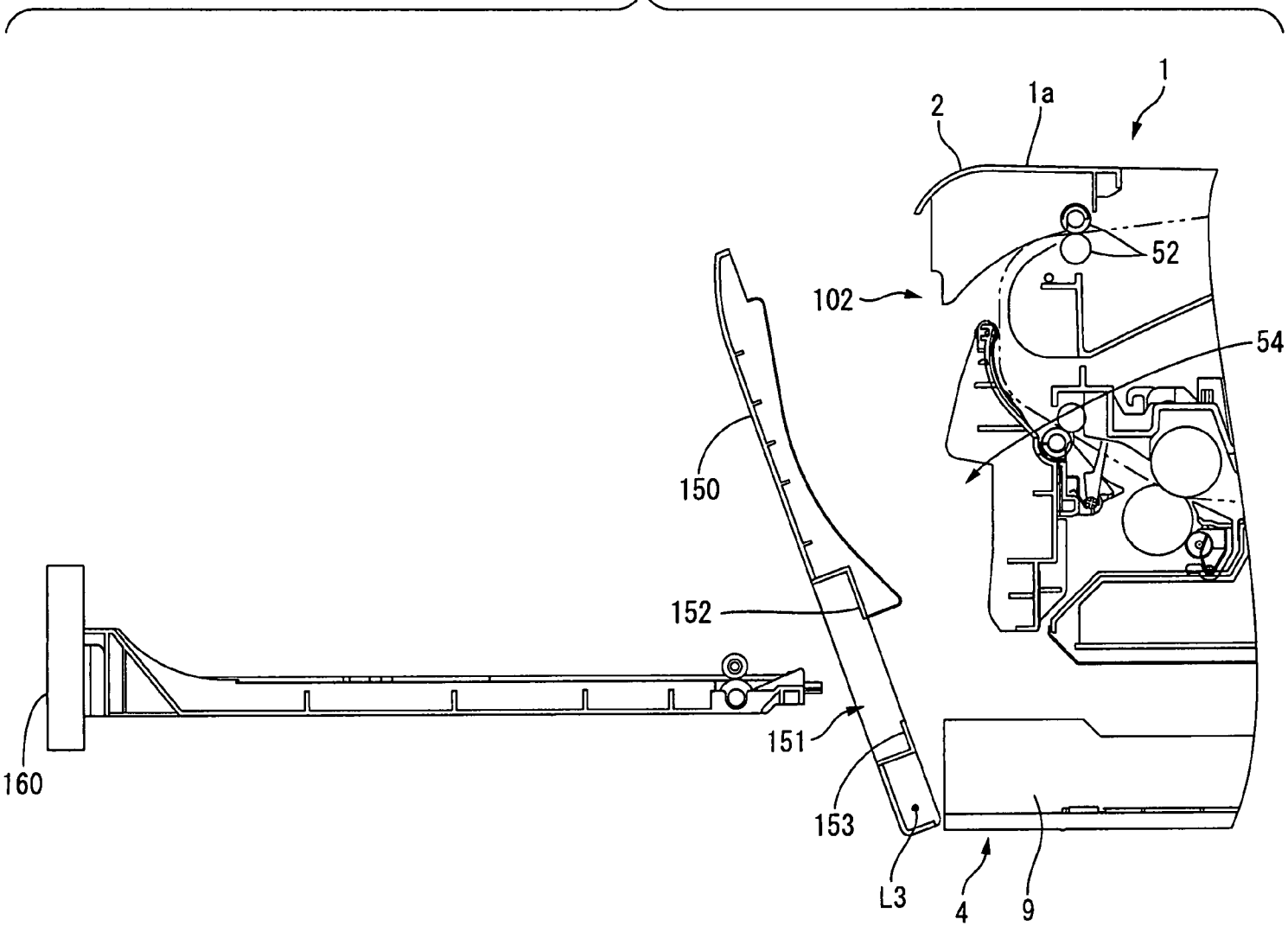
FIG. 11 is an explanatory view showing a state of opening a cover member and removing a tray member with regard to the laser printer shown in FIG. 10.

FIG. 10 is a side sectional view of an essential portion showing a laser printer according to second illustrative aspect and FIG. 11 is an explanatory view showing a state of removing a tray member and opening a cover member with regard to the laser printer of FIG. 10. According to the illustrative aspect, configurations of the cover member, the tray member and detecting units differ from those of first illustrative aspect and other configuration is similar to that in first illustrative aspect, similar portions are attached with notations the same as those of first illustrative aspect and a detailed explanation thereof will be omitted. Further, also the illustrative aspect is provided with a cover member 150 (first guide member of the illustrative aspect) and a tray member 160 (second guide member of the illustrative aspect) respectively constituted displaceably relative to the apparatus main body of the image forming apparatus, and provided with a single detecting units 155 capable of detecting that both of the cover member 150 and the tray member 160 are disposed at normal guide positions. The cover member 150 of the illustrative aspect is constituted to be pivoted centering on an axis line L3 as shown by FIG. 11, on the other hand, the tray member 160 is constituted to be attached and detached by being slid.

According to the second illustrative aspect, the cover member 150 is maintained at a closed position only when the tray member 160 is attached. Specifically, the cover member 150 is formed with an inserting hole 151 for inserting the tray member 160, by attaching the tray member 160 to the apparatus main body 1*a* by inserting the tray member 160 through the inserting hole 151, outer faces 152 and 153 of the cover member 150 are pressed by an inner face of the tray member 160 and the cover member 150 is maintained in a closed state. Detecting units 155 is constituted as the sensor device for detecting whether the tray member 160 is attached and it can be detected whether the both members are disposed at normal positions by detecting a state of attaching the tray member 160.

Further, also the cover member 150 of the second illustrative aspect is configured to open and close the opening portion 102 communicated with the duplex printing conveying path 54 at the face on the side opposed to the face on the side of drawing out the sheet feeding tray 9 (FIG. 10) in the apparatus main body 1*a*. Further, also the tray member 160 of the second illustrative aspect is configured to be able to be drawn out in the direction on the side inverse to the direction of drawing out the sheet feeding tray 9 at the face on the side inverse to the face on the side of drawing out the sheet feeding tray 9. Further, the both members 150, 160 are made to constitute the duplex printing conveying path 54 similar to first illustrative aspect.

Third Illustrative Aspect

Figure 12:
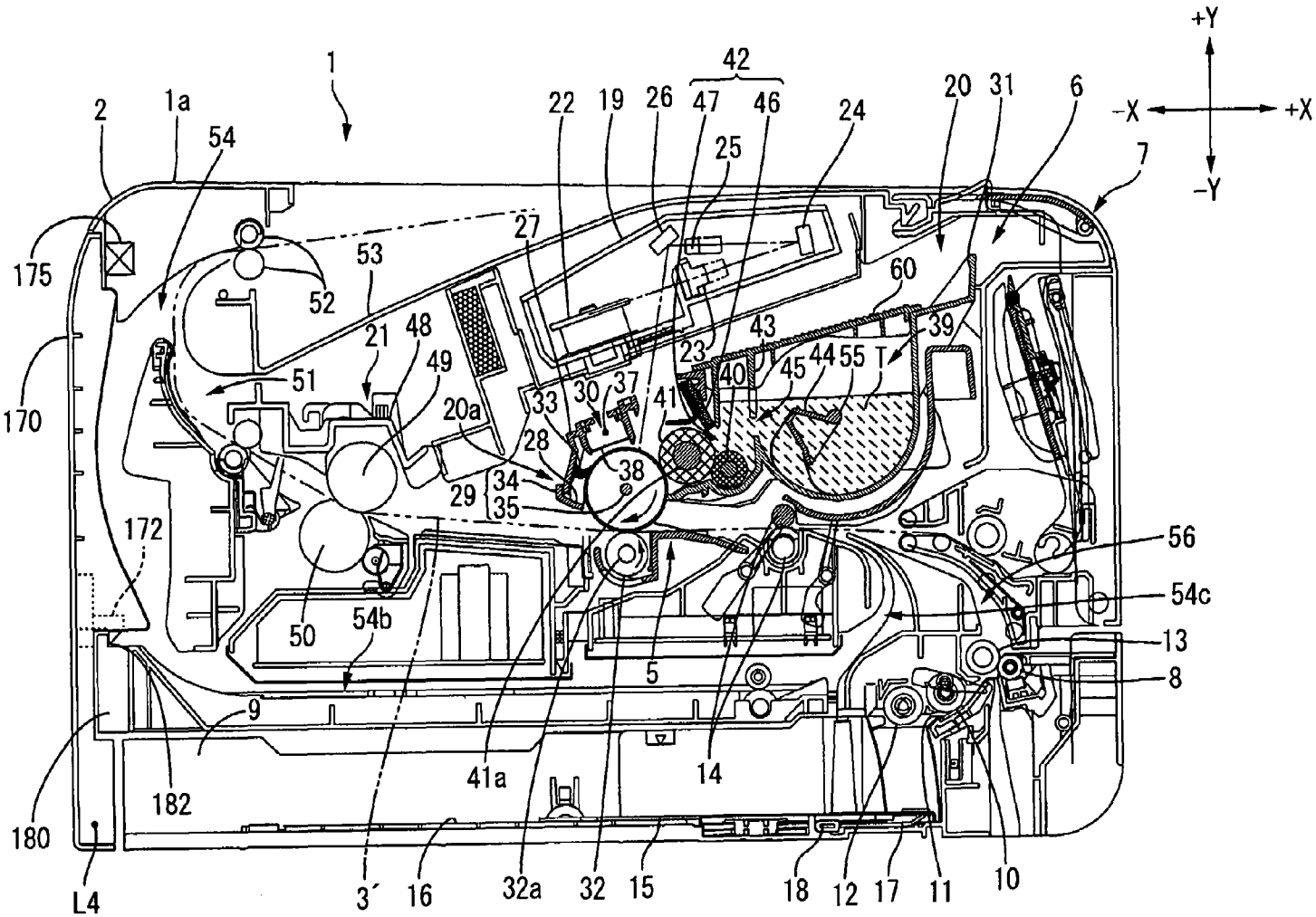
FIG. 12 is a side sectional view of an essential portion showing a laser printer according to a third illustrative aspect.
Figure 13:
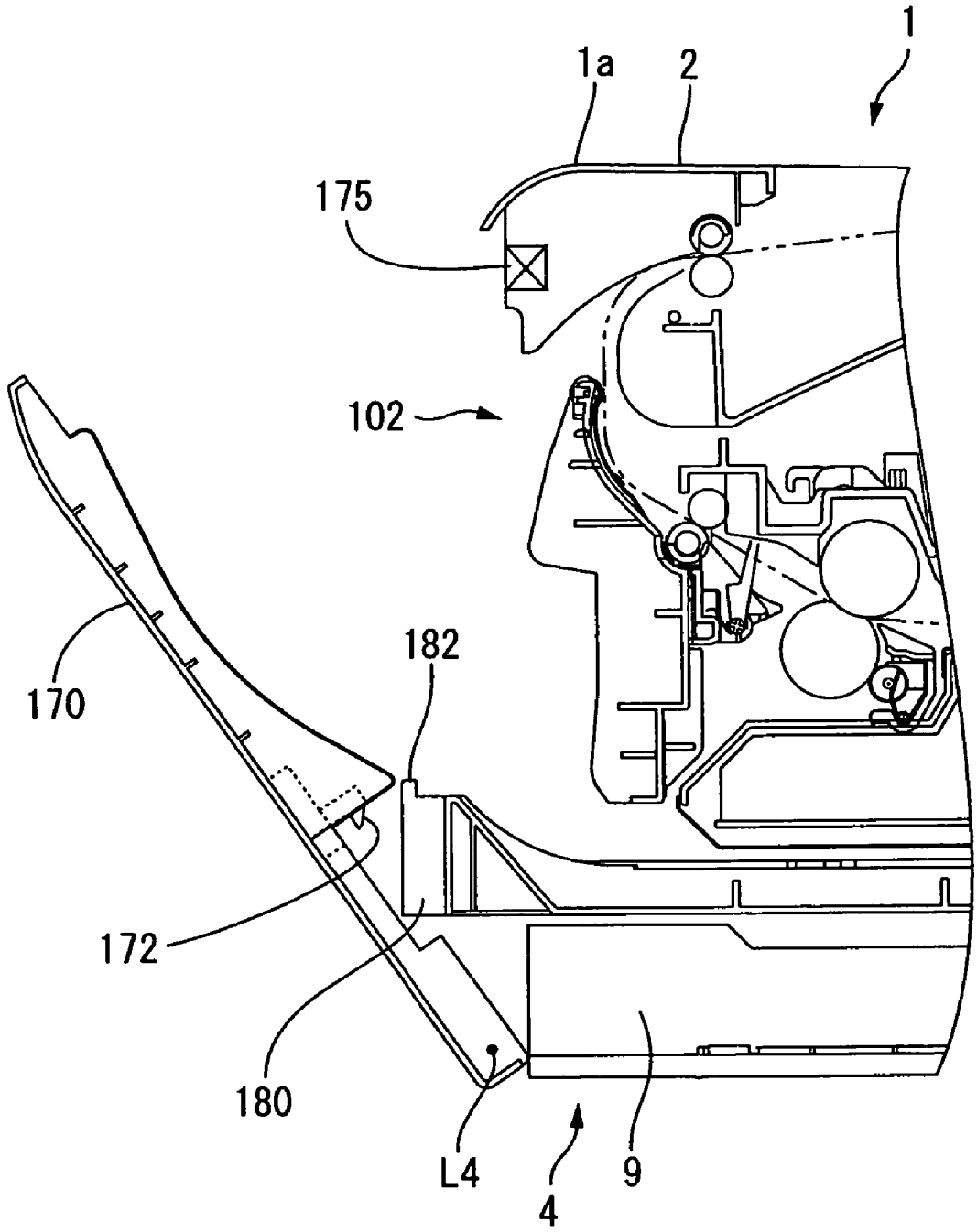
FIG. 13 is an explanatory view showing a state of opening the cover member and removing the tray member with regard to the laser printer shown in FIG. 12.

Next, a third illustrative aspect will be explained in reference to FIGS. 12 and 13. FIG. 12 is a side sectional view of an essential portion showing a laser printer according to the third illustrative aspect and FIG. 13 is an explanatory view showing a state of opening a cover member and removing a tray member with regard to the laser printer shown in FIG. 12. Although according to the illustrative aspect, configurations of the cover member, the tray member and detecting units differ from those of the first and second illustrative aspects, other configuration is similar to those of the first and second illustrative aspects, similar portions are attached with notations the same as those of the first and second illustrative aspects and a detailed explanation thereof will be omitted.

Further, also the third illustrative aspect is provided with a cover member 170 (first guide member in the third illustrative aspect) and a tray member 180 (second guide member in the third illustrative aspect) respectively constituted displaceably relative to the apparatus main body of the image forming apparatus and provided with a single detecting units 175 capable of detecting that both of the cover member 170 and the tray member are disposed at normal guide positions. Further, as shown by FIG. 13, the cover member 170 is configured to be pivoted centering on an axis line L4, on the other hand, the tray member 180 is configured to be attached and detached by being slid.

The third illustrative aspect is configured such that the cover member 170 can be maintained at a closed position only when the tray member 180 is attached. Specifically, the tray member 180 is formed with an engaging portion 182 and the cover member 170 is formed with an engaged portion 172. In a state of attaching the tray member 180 as shown by FIG. 12, the engaging portion 182 is present at a position in correspondence with the engaged portion 172 and therefore, the engaging portion 182 and the engaged portion 172 are engaged with each other and the cover member 170 is maintained at the closed position. Further, the detecting units 175 detects the closed state of the cover member 170. That is, when the tray member 180 is not attached, the cover member 170 does not continue to be held and therefore, when the detecting units 175 detects closing of the cover member 172, it is found that both of the cover member 170 and the tray member 180 are disposed at normal guide positions.

Further, also the cover member 170 of the third illustrative aspect is configured to open and close the opening portion 102 communicated with the duplex printing conveying path 54 at the face on the side opposed to the face on the side of drawing out the sheet feeding tray (FIG. 12) in the apparatus main body 1*a*. Further, also the tray member 180 of the third illustrative aspect is configured to be able to be drawn out in the direction on the side inverse to the direction of drawing out the sheet feeding tray 9 at the face on the side opposed to the face on the side of drawing out the sheet feeding tray 9. Further, the both members 170, 180 constitute the duplex printing conveying path 54 similar to first illustrative aspect.

Other Illustrative Aspect

The present invention is not limited to the illustrative aspects explained by the above-described description and the drawings. However, for example, the following illustrative aspect is included in the technical scope of the present invention, further, the present invention can be embodied by being variously changed within the range not deviated from the gist other than described below.

(1) Although according to the above-described illustrative aspects, both of the first guide member and the second guide member are made to constitute the guide members constituting the duplex printing conveying path, either or both of the first guide member and the second guide member may constitute other than the duplex printing conveying path. For example, either or both of the first guide member and the second guide member may be a guide member constituting a conveying path used only for one face printing and either or both of the first guide member and the second guide member may be a guide member constituting a conveying path used for both of one face printing and duplex printing.

As described in detail with reference to the illustrative aspects, there is provided a configuration listed below.

(1) An image forming apparatus including: an apparatus main body that is provided with an image forming section that forms image on a sheet; a first guide member that guides the sheet along a sheet conveying path and is configured to be displaceable relative to the apparatus main body; a second guide member that guides the sheet along the sheet conveying path and is configured to be displaceable relative to the apparatus main body; and a single detecting unit that detects that both of the first guide member and the second guide member are respectively disposed at normal guide positions for guiding the sheet.

(2) The image forming apparatus according to (1), wherein both of the first guide member and the second guide member guide the sheet along a duplex printing conveying path used for performing a duplex printing.

(3) The image forming apparatus according to (1), wherein the detecting unit includes: a displacing member that displaces in conjunction with displacements of the first guide member and the second guide member; and a sensor device that detects a displacement of the displacing member, and wherein the displacing member is displaced to a first displacement position when both of the first guide member and the second guide member are respectively disposed at the normal guide positions, and is displaced to a second displacement position when at least one of the first guide member and the second member is displaced from the respective normal guide positions.

(4) The image forming apparatus according to (3), further including an urging member that urges the displacing member toward the second displacement position.

(5) The image forming apparatus according to (2), wherein the first guide member is configured as a cover member that opens and closes an opening that communicates with the duplex printing conveying path, and wherein the second guide member is configured as a tray member that is attachable to and detachable from the apparatus main body.

(6) The image forming apparatus according to (5), further including a sheet feeding tray that is mounted to the apparatus main body to be drawable from a first face of the apparatus main body in a first direction, wherein the cover member is configured to be openable and closable at a second face of the apparatus main body, the second face being opposed to the first face, and wherein the tray member is configured to be drawable from the second face of the apparatus main body in a second direction opposite to the first direction.

(7) The image forming apparatus according to (5), wherein both of the first guide member and the second guide member guide the sheet along a duplex printing conveying path used for performing a duplex printing, wherein the detecting unit includes: a displacing member that displaces in conjunction with displacements of the first guide member and the second guide member; and a sensor device that detects a displacement of the displacing member, wherein the displacing member is displaced to a first displacement position when both of the first guide member and the second guide member are respectively disposed at the normal guide positions, and is displaced to a second displacement position when at least one of the first guide member and the second member is displaced from the respective normal guide positions, wherein either one of the cover member and the tray member is provided with the displacing member to be pivotable, and the other one of the cover member and the tray member is provided with a press operating portion that presses the displacing member, and wherein the displacing member is configured to be maintained at a position to be pressed by the press operating portion when both of the cover member and the tray member are respectively disposed at the normal guide positions.

(8) The image forming apparatus according to (5), wherein the tray member is configured to be attachable and detachable in a state where the cover member is closed, and wherein the cover member is configured to be openable and closable in a state where the tray member is attached to the apparatus main body.

(9) The image forming apparatus according to (7), wherein the cover member is provided with the press operating portion, wherein when the cover member is operated to be opened or closed while the tray member is attached to the apparatus main body, the displacing member is disposed on a movement path of the press operating portion to be displaced out of the movement path of the press operating portion by being pressed by the press operating portion that is displaced in accordance with the operation of the cover member, and wherein when the tray member is operated to be attached to or detached from the apparatus main body while the cover member is closed, the press operating portion is disposed on a movement path of the displacing member to displace the displacing member along a movement path that retracts the displacement member from a position where the displacement member interfere with the press operating portion, by being displaced in accordance with the operation of the tray member.

(10) The image forming apparatus according to (7), wherein the press operating portion is formed with a faced portion for guiding the displacing member.

(11) The image forming apparatus according to (5), wherein the cover member includes a closing portion that closes the opening, and is pivotably supported by the apparatus main body at a lower end side of the cover member, wherein the tray member is provided to be contiguous to the cover member at a portion lower to the cover member, and is displaceably attached with the displacing member, and wherein the press operating portion is projected to a side of being opposed to the closing portion relative to a pivoting axis line of the cover member.

(12) The image forming apparatus according to (5), wherein both of the first guide member and the second guide member guide the sheet along a reconveying path used for conveying the sheet formed with the image by the image forming section to the image forming section again after inverting a front face and a back face of the sheet.

(13) The image forming apparatus according to (1), wherein the detecting unit include a sensor device that is provided in the apparatus main body.

(14) An image forming apparatus including: an apparatus main body that is provided with an image forming section that forms image on a sheet; a cover member that opens and closes an opening that communicates with a sheet conveying path; a tray member that is attachable to and detachable from the apparatus main body, wherein the tray member retains the cover member in a closed position that closes the opening when the tray member is attached to the apparatus main body.

(15) The image forming apparatus according to (14), wherein the cover member includes a cover portion that closes the opening and an axis portion that is provided at a position lower than the cover portion, and wherein the tray member retains the cover member to be disposed in a vertical direction.

(16) The image forming apparatus according to (15), wherein the cover member is provided with an inserting hole for inserting the tray member therethrough when the cover member is in the closed position, and wherein the tray member abuts the cover member from an upstream side with respect to an attaching direction thereof when attaching the tray member to the apparatus main body.

(17) The image forming apparatus according to (15), wherein the cover member includes an engaged portion that engages with the tray member when the tray member is attached to the apparatus main body.

(18) The image forming apparatus according to (14), wherein the cover member and the tray member guide the sheet along a duplex printing conveying path used for performing a duplex printing.

According to the configuration of (1), it can be detected whether or not the first and second guide members are normal and therefore, the sheet can effectively be prevented from being carried in an abnormal path state. Further, there is provided a configuration of detecting whether the two guide members are disposed at the normal positions by the single detecting units and an apparatus configuration can be simplified and a number of parts can be reduced effectively after realizing a configuration capable of detecting an abnormality.

According to the configuration of (2), the configuration capable of detecting an abnormality of the duplex printing conveying path can simply be realized.

According to the configuration of (3), the displacing member is displaced by reflecting states of the both guide members and by only detecting the displacement of the displacing member by the sensor device, it can accurately be known whether both of the two guide members are disposed at the normal guide positions. That is, there is provided an excellent configuration capable of detecting states of the both guide members by the single detecting units without using a complicated configuration.

According to the configuration of (4), the displacing member is stably maintained at the second displacement position when the displacing member is not pressed and erroneous detection or damage of the displacing member can effectively be prevented.

According to the configuration of (5), the duplex printing conveying path can widely and easily be opened by operating the cover member and tray member and therefore, an operator can easily carry out operation of jam treatment or the like. On the other hand, when constituted in this way, although operation facility is promoted, duplex printing is liable to be carried out while the cover member stays to be opened after operation or while the tray member is insufficiently attached, according to the configuration, these can effectively be prevented by a simple configuration.

Although when a part for making access to the duplex printing conveying path is provided on the side of the face opposed to the side of drawing out the sheet feeding tray, the arrangement of the part is advantageous in view of design and in view of use, when configured in this way, the part is difficult to be recognized optically by the operator. However, according to configuration of (6), there can be simply detected whether or not the both guide members are brought into the normal states under such configuration. Thereby, a failure of the operator in optically recognizing the part can be compensated effectively.

According to the configuration of (7), the states of the both guide members can simply be reflected to the displacing member to construct a preferable configuration capable of further simplifying the detection configuration.

According to the configuration of (8), when either one member of the cover member and the tray member constituting the sheet conveying path is disposed at the normal position, other member can be displaced independently therefrom and operability is made to be extremely excellent.

According to the configuration of (9), even when the cover member is opened and closed in the state of attaching the tray member or even when the tray member is attached and detached in the state of closing the cover member, the displacing member and the press operating member do not hamper movements of counterparts thereof. Therefore, even when the cover member is operated by itself or even when the tray member is operated by itself, the operation is not failed by interference between the press operating portion and the displacing member to construct a configuration having an extremely excellent way of use.

According to the configuration of (10), impact applied to the press operating portion by the displacing member can be escaped and the displacing member can smoothly be escaped.

According to the configuration of (11), there is provided a preferable configuration capable of cooperatively moving the press operating portion in accordance with opening and closing the cover member and the press operating portion is made to be easy to be operated to the displacing member without using a large-scaled configuration or a complicated configuration.

According to the configuration of (12), a preferable example capable of printing the both faces is constituted, further, the reconveying path includes the displaceable cover member and the displaceable tray member and therefore, there is constructed a configuration of the reconveying path for which maintenance is easy to be carried out. Furthermore, the states of the two guide members constituting the reconveying path can be detected by the single detecting units and therefore, while realizing the reconveying path facilitating maintenance, both of simplification of the apparatus configuration and a reduction in a number of parts can be achieved.

According to the configuration of (13), the sensor device constituting the detecting units is provided at the apparatus main body and therefore, a configuration of connecting the detecting units and various boards (configuration of wiring or the like) can be simplified.

According to the configuration of (14), a need for providing a separate retaining mechanism for retaining the cover member in the closed position can be eliminated.

In order to downsize an image forming apparatus, it is preferable to provide the cover member to be disposed in the vertical direction. In addition, it is also preferable to provide the axis portion of the cover member at the position lower than the cover portion for reducing an opening force to open the cover member. In this case, the cover member needs to be retained in the vertical direction by a retaining mechanism. However, according to the configuration of (15), the tray member retains the cover member in the vertical direction, whereby the separate retaining mechanism can be eliminated.

According to the configuration of (16), the tray member abuts the cover member from the upstream side with respect to the attaching direction thereof when attaching the tray member to the apparatus main body. According to the configuration, the cover member could not be retained in the closed position without the tray member being inserted through the inserting hole provided in the cover member. Accordingly, a malfunction caused by the tray member being unattached can be prevented.

According to the configuration of (17), the cover member engages with the tray member by the engaged portion when the tray member is attached to the apparatus main body. According to the configuration, the cover member could not be retained in the closed position without the tray member being correctly attached. Accordingly, a malfunction caused by the tray member being unattached can be prevented.

According to the configuration of (18), the image forming apparatus can steadily perform the duplex printing by the cover member being retained at the closed position. The foregoing description of the illustrative aspects has been presented for purposes of illustration and description. It is not intended to be exhaustive or to limit the invention to the precise form disclosed, and modifications and variations are possible in light of the above teachings or may be acquired from practice of the invention. The illustrative aspects were chosen and described in order to explain the principles of the invention and its practical application program to enable one skilled in the art to utilize the invention in various illustrative aspects and with various modifications as are suited to the particular use contemplated. It is intended that the scope of the invention be defined by the claims appended hereto, and their equivalents.

What is claimed is:

1. An image forming apparatus comprising:

an apparatus main body that is provided with an image forming section that forms an image on a sheet;

a first guide member that guides the sheet along a sheet conveying path and is configured to be displaceable relative to the apparatus main body;

a second guide member that guides the sheet along the sheet conveying path and is configured to be displaceable relative to the apparatus main body; and a single detecting unit that detects that both of the first guide member and the second guide member are respectively disposed at normal guide positions for guiding the sheet, wherein the detecting unit comprises:

a displacing member that displaces in conjunction with displacements of the first guide member and the second guide member; and a sensor device that detects a displacement of the displacing member, and wherein the displacing member is displaced to a first displacement position when both of the first guide member and the second guide member are respectively disposed at the normal guide positions, and is displaced to a second displacement position when at least one of the first guide member and the second member is displaced from the respective normal guide positions, wherein either one of the first guide member and the second guide member is provided with the displacing member to be pivotable, and the other one of the first guide member and the second guide member is provided with a press operating portion that presses the displacing member, and wherein the displacing member is configured to be maintained at a position to be pressed by the press operating portion when both of the first guide member and the second guide member are respectively disposed at the normal guide positions.

2. The image forming apparatus according to claim 1, wherein both of the first guide member and the second guide member guide the sheet along a duplex printing conveying path used for performing a duplex printing.

3. The image forming apparatus according to claim 2, wherein the first guide member is configured as a cover member that opens and closes an opening that communicates with the duplex printing conveying path, and wherein the second guide member is configured as a tray member that is attachable to and detachable from the apparatus main body.

4. The image forming apparatus according to claim 3, further comprising a sheet feeding tray that is mounted to the apparatus main body to be drawable from a first face of the apparatus main body in a first direction, wherein the cover member is configured to be openable and closable at a second face of the apparatus main body, the second face being opposed to the first face, and wherein the tray member is configured to be drawable from the second face of the apparatus main body in a second direction opposite to the first direction.

5. The image forming apparatus according to claim 3, wherein the tray member is configured to be attachable and detachable in a state where the cover member is closed, and wherein the cover member is configured to be openable and closable in a state where the tray member is attached to the apparatus main body.

6. The image forming apparatus according to claim 3, wherein the cover member is provided with the press operating portion, wherein when the cover member is operated to be opened or closed while the tray member is attached to the apparatus main body, the displacing member is disposed on a movement path of the press operating portion to be displaced out of the movement path of the press operating portion by being pressed by the press operating portion that is displaced in accordance with the operation of the cover member, and wherein when the tray member is operated to be attached to or detached from the apparatus main body while the cover member is closed, the press operating portion is disposed on a movement path of the displacing member to displace the displacing member along a movement path that retracts the displacement member from a position where the displacement member interferes with the press operating portion, by being displaced in accordance with the operation of the tray member.

7. The image forming apparatus according to claim 3, wherein the press operating portion is formed with a faced portion for guiding the displacing member.

8. The image forming apparatus according to claim 3, wherein the cover member includes a closing portion that closes the opening, and is pivotably supported by the apparatus main body at a lower end side of the cover member, wherein the tray member is provided to be contiguous to the cover member at a portion lower to the cover member, and is displaceably attached with the displacing member, and wherein the press operating portion is projected to a side of being opposed to the closing portion relative to a pivoting axis line of the cover member.

9. The image forming apparatus according to claim 3, wherein both of the first guide member and the second guide member guide the sheet along a reconveying path used for conveying the sheet formed with the image by the image forming section to the image forming section again after inverting a front face and a back face of the sheet.

10. The image forming apparatus according to claim 1, further comprising an urging member that urges the displacing member toward the second displacement position.

11. The image forming apparatus according to claim 1, wherein the detecting unit include a sensor device that is provided in the apparatus main body.

12. The image forming apparatus according to claim 1, wherein the sensor device is attached to the apparatus main body.

13. An image forming apparatus comprising:

an apparatus main body that is provided with an image forming section that forms image on a sheet;

a cover member that opens and closes an opening that communicates with a sheet conveying path;

a tray member that is attachable to and detachable from the apparatus main body, wherein the tray member retains the cover member in a closed position that closes the opening when the tray member is attached to the apparatus main body.

14. The image forming apparatus according to claim 13, wherein the cover member includes a cover portion that closes the opening and an axis portion that is provided at a position lower than the cover portion, and wherein the tray member retains the cover member to be disposed in a vertical direction.

15. The image forming apparatus according to claim 14, wherein the cover member is provided with an inserting hole for inserting the tray member therethrough when the cover member is in the closed position, and wherein the tray member abuts the cover member from an upstream side with respect to an attaching direction thereof when attaching the tray member to the apparatus main body.

16. The image forming apparatus according to claim 14, wherein the cover member includes an engaged portion that engages with the tray member when the tray member is attached to the apparatus main body.

17. The image forming apparatus according to claim 13, wherein the cover member and the tray member guide the sheet along a duplex printing conveying path used for performing a duplex printing.

* * * * *